US011369208B2

(12) United States Patent
Skelton

(10) Patent No.: US 11,369,208 B2
(45) Date of Patent: Jun. 28, 2022

(54) PROTECTIVE CANOPY FOR BED

(71) Applicant: The Center for Toxicology and Environmental Health, LLC, North Little Rock, AR (US)

(72) Inventor: Scott Skelton, Quitman, AR (US)

(73) Assignee: THE CENTER FOR TOXICOLOGY AND ENVIRONMENTAL HEALTH, LLC, North Little Rock, AR (US)

( * ) Notice: Subject to any disclaimer, the term of this patent is extended or adjusted under 35 U.S.C. 154(b) by 0 days.

(21) Appl. No.: 17/221,067

(22) Filed: Apr. 2, 2021

(65) Prior Publication Data

US 2021/0307535 A1 Oct. 7, 2021

Related U.S. Application Data

(60) Provisional application No. 63/004,745, filed on Apr. 3, 2020.

(51) Int. Cl.
*A47C 29/00* (2006.01)

(52) U.S. Cl.
CPC ..... *A47C 29/003* (2013.01)

(58) Field of Classification Search
CPC ..... A47C 29/00; A47C 29/003; A47C 29/006
See application file for complete search history.

(56) References Cited

U.S. PATENT DOCUMENTS 2,190,867 A 2/1940 Felciano
4,152,792 A 5/1979 Glintz
4,885,000 A 12/1989 Hogan
5,511,259 A * 4/1996 Tarara ..... A61G 1/04 135/147
7,971,596 B2 7/2011 Morris et al.
9,750,349 B1 9/2017 Lloyd
9,765,545 B1 9/2017 Petrenko
9,850,681 B2 12/2017 Le
2005/0241648 A1* 11/2005 Dobbs ..... A61G 1/04 128/857
2014/0090680 A1* 4/2014 Reis ..... A61G 1/017 135/96
2016/0115704 A1 4/2016 Burke

* cited by examiner

*Primary Examiner* — Fredrick C Conley

(74) *Attorney, Agent, or Firm* — Shlesinger, Arkwright & Garvey LLP

(57) ABSTRACT

The invention is a foldable protective canopy for attachment to a bed, the canopy comprising at least first, second and third generally U-shaped frames including respective ends joined at first and second hinges removably attachable to a bed, the canopy having a deployed position wherein the first and second U-shaped frames extend upwardly and the third U-shaped frame extends horizontally from the first and second hinges, a flexible sheet is secured to the first, second and third U-shaped frames, the sheet forming a top wall and side walls over the patient, the first U-shaped frame defining an opening into the canopy to permit room air to enter the canopy, the canopy including a folded position wherein the first and second U-shaped frames are rotatable about the first and second hinges toward the third U-shaped frame to expose the head of a patient.

9 Claims, 4 Drawing Sheets

PROTECTIVE CANOPY FOR BED

CROSS-REFERENCE TO RELATED APPLICATIONS

This application claims the benefit of priority from U.S. Provisional Application Ser. No. 63/004,745, filed on Apr. 3, 2020, which is incorporated herein by reference.

FIELD OF THE INVENTION

The present invention relates to medical devices, and in particular, a device for providing a protective shield around a patient when in a hospital bed or other bed.

BACKGROUND OF THE INVENTION

Medical professionals are known to wear personal protective equipment when treating or assisting a patient. The equipment is designed to prevent contact with airborne pathogens, fluids such as blood, or other potential contagions. Personal protective equipment includes medical gowns, masks, gloves, goggles and face shields, all of which function as physical barriers.

Although personal protective equipment will shield the wearer from direct contact with a patient, the environment surrounding the patient will remain unprotected. Any contagious aerosol generated by coughing or sneezing of the patient will contaminate the hospital room and require sanitizing of nearby surfaces.

A need has therefore existed for protective equipment that will shield the airspace around the patient when in a hospital bed yet permit medical equipment, such as an IV or monitor, to be connected to the patient.

BRIEF SUMMARY OF THE INVENTION

The present invention is directed to a foldable protective canopy adapted to be secured to the rails of a hospital bed, the canopy comprising a frame member, the frame member consisting of at least three separate arm members, the respective ends of the arm members are adapted to be pivotally secured to opposite rails of the hospital bed to extend between an unfolded position and a folded position, the width of each of the arms members extends about the width of the hospital bed and the lengths of each arms member is preferably different than the length of the other arms members, a flexible barrier sheet is secured to each of the arm members so as to form a canopy around a patient in the bed, the sheet member does not extend beyond one of the arm members whereby one end of the canopy is maintained open to the patient.

The present invention is also directed to a foldable protective canopy for attachment to a patient's bed, the canopy comprising at least first, second and third generally U-shaped frames including respective ends joined at first and second hinges removably attachable to a bed, the canopy having a deployed position wherein the first and second U-shaped frames extend upwardly and the third U-shaped frame extends horizontally from the first and second hinges, a flexible sheet being secured to the first, second and third U-shaped frames, the sheet forming a top wall and side walls over the patient, the first U-shaped frame defining an opening into the canopy to permit room air to enter the canopy, the canopy including a folded position wherein the first and second U-shaped frames are rotatable about the first and second hinges toward the third U-shaped frame to expose the head of a patient.

DETAILED DESCRIPTION OF THE INVENTION

Figure 1:
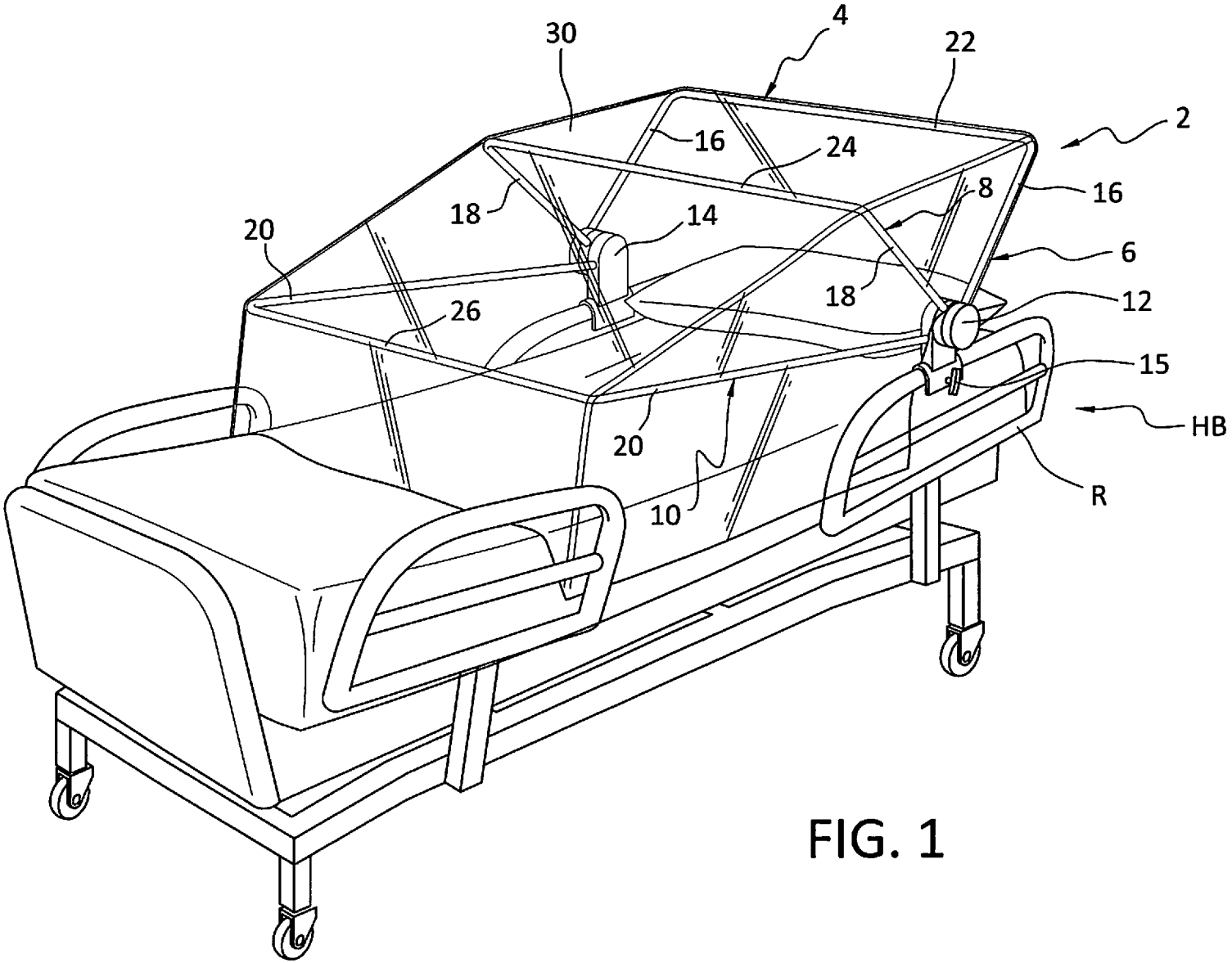
FIG. 1 is a perspective view of the foldable canopy of the present invention secured to a hospital bed and in a deployed position.

FIG. 1 illustrates the foldable protective canopy 2 according to the present invention when attached to the rails R of a hospital bed HB.

The canopy 2 has a frame member 4 shown to comprise separately movable arm members or U-shaped frames 6, 8 and 10. Other configurations, e.g. bow shaped, are within the scope of the invention. The U-shaped frames may be formed from any rigid, lightweight material such as aluminum, plastic or the like.

Figure 2:
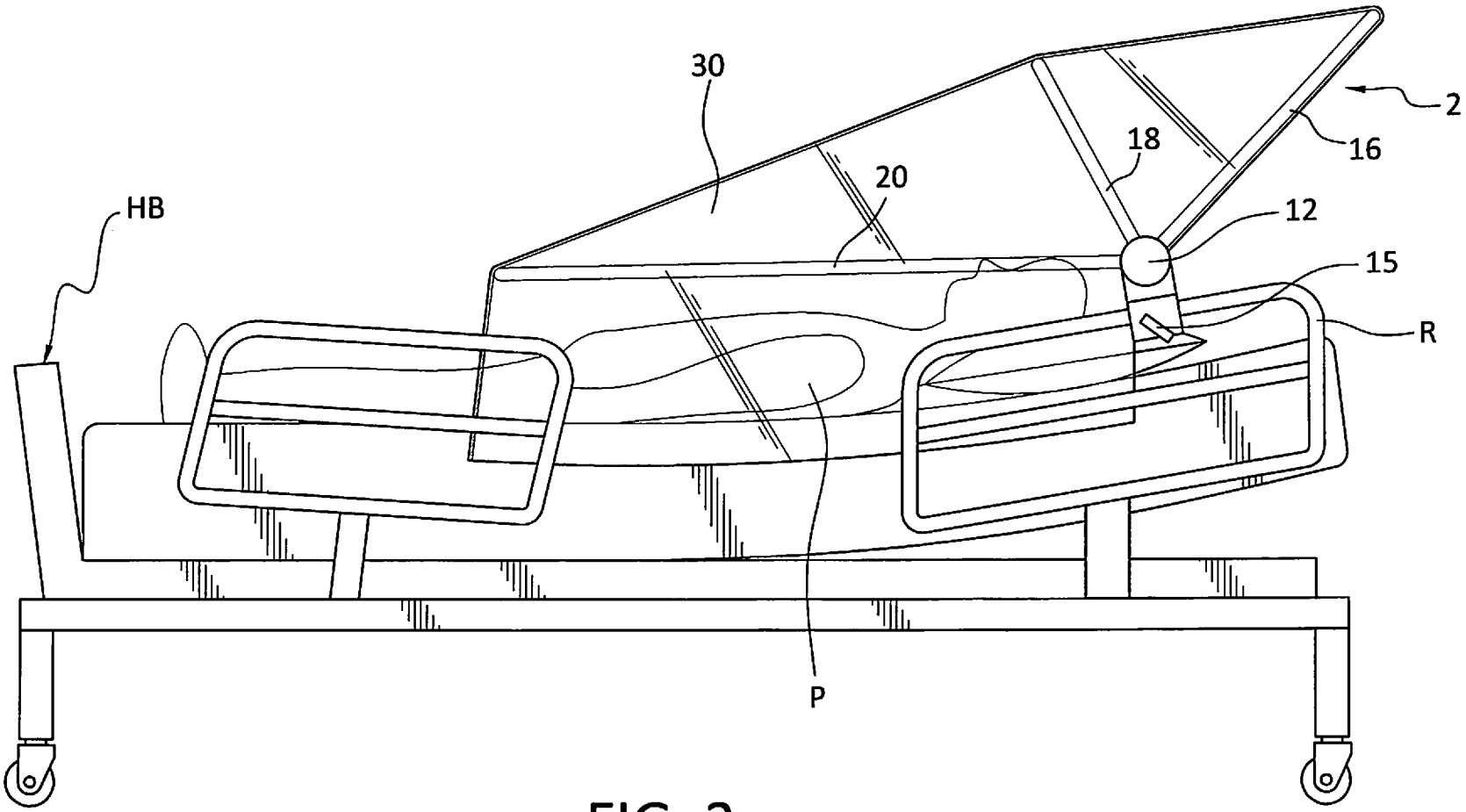
FIG. 2 is a side view of the device shown in FIG. 1 with a patient lying in the bed.
Figure 3:
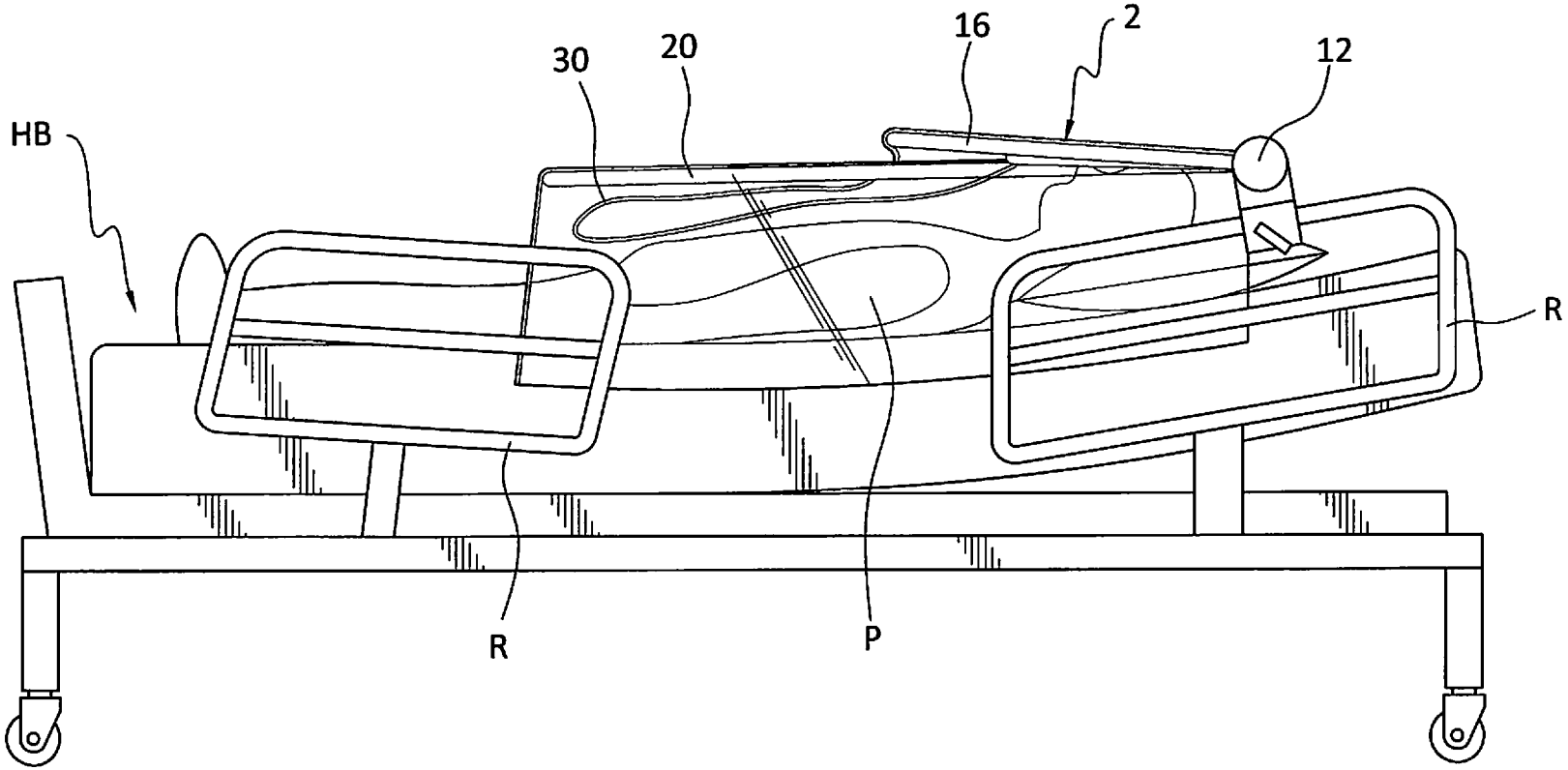
FIG. 3 is the side view of the device in FIG. 2 with the canopy shown in a folded position.

The ends of the U-shaped frames 6, 8 and 10 are secured at their ends to respective hinges or pivot joints 12, 14 provided with clamps 15. In a preferred embodiment, the respective side portions 16, 18, and 20 of U-shaped frames 6, 8 and 10 are of different lengths. As best shown in FIGS. 2 and 3, side portion 20 has the greatest length, side portion 18 has the shortest length and arm member side 20 has a length between that of the longest and shortest. Each of the U-shaped frames 6, 8 and 10 is provided with a top portion 22, 24 and 26 respectively that extends from cooperating ends of the side portions.

A flexible sheet member 30 is secured to each of the U shaped frames 6, 8 and 10. Sheet member 30 is shown to extend beyond U-shaped frame 10 at a first end of the canopy 2 but does not extend substantially beyond upwardly extending arm member 6 at the opposite end of the canopy 2 so as to provide an opening into the canopy to allow room air to enter the interior region of the canopy. In a preferred embodiment, the sheet is constructed from an impervious plastic material that is also transparent so that a patient can be viewed while underneath the deployed canopy.

As best shown in FIGS. 1 and 2, when the canopy is fully deployed, flexible sheet member 30 includes a top wall that extends between top portions 22, 24 and 26 and extends beyond top portion 26. The remaining portions of the flexible sheet form side walls that generally correspond to the side portions 16, 18, and 20 of U-shaped frame members 6, 8 and 10 and extend beyond side portion 20 of frame member 10. This enables portions of the flexible sheet that extend beyond frame member 10 to drape over the bed in an unimpeded manner to effectively restrict aerosols generated by patient to the interior region of the canopy. The flexible sheet does not substantially extend beyond U-shaped frame 6 when the canopy is in the deployed position so as to provide an opening into the canopy that allows room air to enter the canopy as well as to allow access to the patient to attach medical equipment. When the canopy is deployed, the range of motion of the U-shaped frame 6 is restricted from extending to a horizontal position so as to provide an opening into the canopy. If desired, the flexible sheet may extend beyond U-shaped frame/arm member 6 to drape behind the patient while still providing an opening and not interfering with medical equipment that may be attached to the patient.

Pivot joints 12 and 14 may comprise separately rotating discs associated with each of the U-shaped members 6, 8 and 10 which are nested together as shown in the drawings. Other hinges or pivot mechanisms are within the scope of the invention. Hinges 12, 14 restrict the range of motion for U-shaped frame 6 so that the canopy will not fully enclose the patient and an open region extending behind the patient is provided when the device is fully deployed. The clamps 15 may comprise a U-shaped locking device as shown or other mechanism for firmly securing the canopy to the bed rails R of the hospital bed BR.

Turning to FIG. 2, a patient P is shown lying in a hospital bed HB with the canopy 2 in a deployed or unfolded position. As can be seen, the region behind the head of the patient is not shielded by the canopy so as to enable medical equipment, such as an IV or monitor (not shown), to be connected to the patient while the fully deployed canopy is in use. Any contagious aerosol generated by patient coughing or sneezing will be substantially prevented from extending beyond the hospital bed. As is apparent, the canopy may be sanitized by wiping or spraying with a disinfectant.

FIG. 3 illustrates the device shown in FIG. 2 when in a folded position. When moving from a deployed position to the folded position, U-shaped frame members 6, 8 are rotatable about hinges 12, 14 toward U-shaped frame/arm member 10 to expose the head of the patient P. In one embodiment of the present invention, U-shaped frame member 10 is fixed and does not rotate so that the body of the patient remains covered by the canopy when it is in a folded position.

Figure 4:
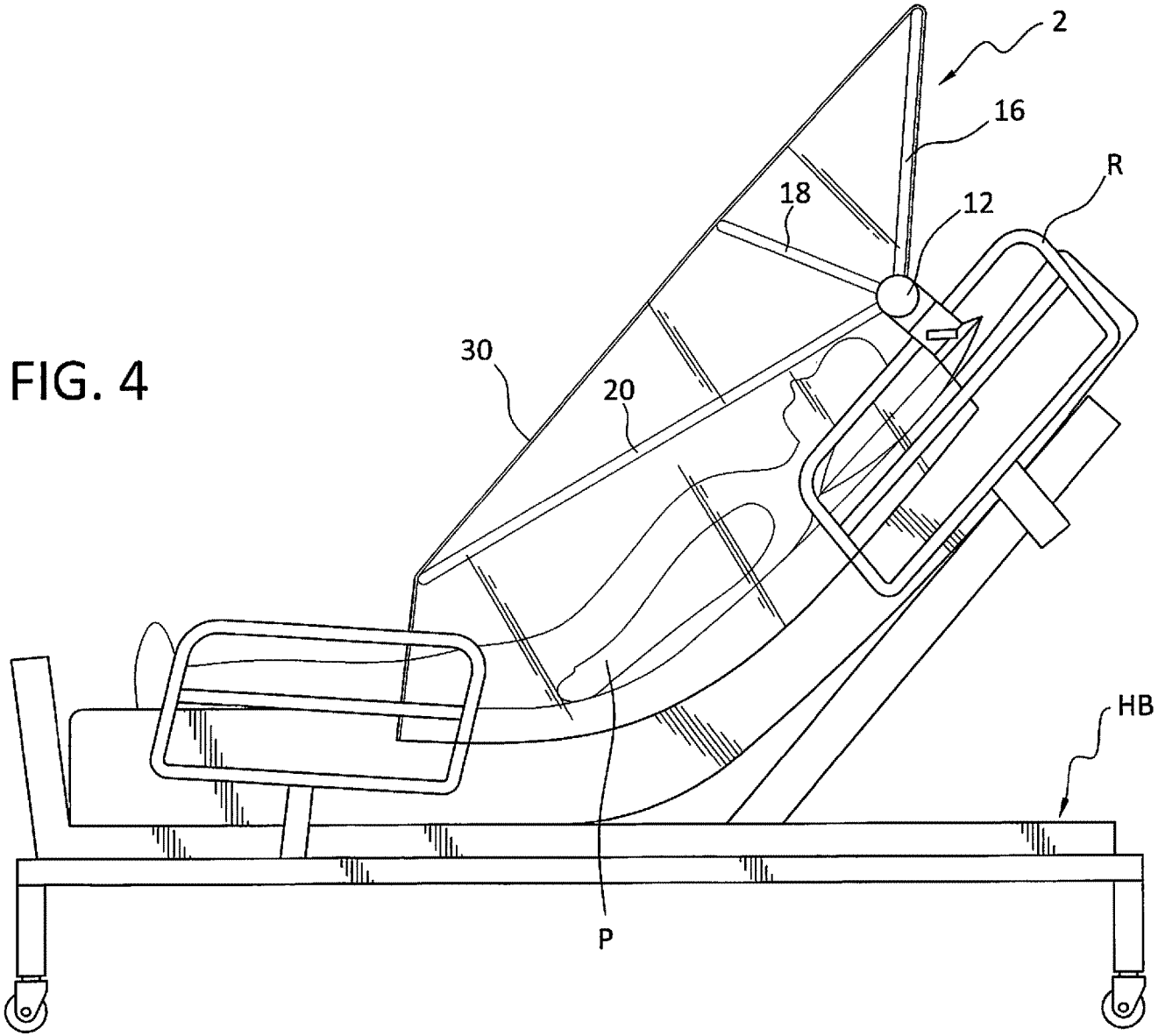
FIG. 4 is a side view of the device shown in FIG. 2 with the hospital bed in a raised or upright position.

FIG. 4 illustrates the device shown FIG. 2, but with the hospital bed HB is in a raised position. As can be seen, the patient continues to be surrounded by the top and side walls of the canopy 2 without any need for adjustment of the device. When the hospital bed HB return to its horizontal position, the canopy 2 continues to surround the patient. This feature provides continuous and uninterrupted protection to medical care providers and eliminates the need for canopy adjustment.

While this invention has been described as having a preferred design, it is understood that it is capable of further modifications, uses and adaptations, both in whole and in part, while following the general principle of the invention including such departures from the present disclosure as is known or customary practice in the art to which this invention pertains, and as may be applied to the central features of this invention.

I claim:

1. A canopy for attachment to a patient bed, comprising:

a) first, second and third U-shaped frames including respective ends joint at first and second hinges;

b) the first and second hinges being removably attachable to a patient bed;

c) the canopy including a deployed position wherein the first and second U-shaped frames extend upwardly and the third U-shaped frame horizontally from the first and second hinges;

d) a flexible sheet being secured to the first, second and third U-shaped frames, the sheet forming a top wall and side walls over the patient when in the deployed position, the first U-shaped frame defining an opening into the canopy to allow ambient air to enter the canopy; and e) the canopy including a folded position where the first and second U-shaped frames are rotatable about the first and second hinges toward the third U-shaped frame to expose the head of a patient.

2. A canopy as in claim 1 and wherein the third U-shaped frame is fixed.

3. A canopy as in claim 1 and wherein each of the first and second hinges includes a clamp for attaching the canopy to rails of a hospital bed.

4. A canopy as in claim 1 and wherein each of the first, second and third U-shaped frames having equal widths, at least one of the U-shaped frames having a length greater than the other of the U-shaped frames.

5. A canopy as in claim 1 and wherein the flexible sheet is adapted to prevent transmission of gas and liquid therethrough.

6. A canopy as in claim 1 and wherein the flexible sheet is transparent.

7. A canopy as in claim 1 and wherein the side walls extend beyond at least one of the first, second and third U-shaped frames.

8. A canopy as in claim 1 and wherein when the canopy is in the folded position each of the first, second U-shaped frame members extends horizontally from the first and second hinges to only expose the head of a patient.

9. A canopy as in claim 1 and wherein the flexible sheet is formed from a plastic material.

* * * * *